US008247633B2

(12) United States Patent
Knupp et al.

(10) Patent No.: US 8,247,633 B2
(45) **Date of Patent: *Aug. 21, 2012**

(54) ENERGY GENERATION PROCESS

(76) Inventors: Stephen L. Knupp, Wilmington, DE (US); John L. Knupp, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/242,450

(22) Filed: Sep. 23, 2011

(65) Prior Publication Data

US 2012/0009111 A1 Jan. 12, 2012

Related U.S. Application Data

(63) Continuation of application No. 11/212,184, filed on Aug. 26, 2005, now Pat. No. 8,034,989.

(51) Int. Cl.
*A62D 3/11* (2007.01)

(52) U.S. Cl. ..... 588/302; 588/406

(58) Field of Classification Search ..... 588/321, 588/301, 302, 305, 306, 307, 406; 423/240 R, 423/204 S See application file for complete search history.

(56) References Cited

U.S. PATENT DOCUMENTS 8,034,989 B2 * 10/2011 Knupp et al. ..... 588/321

* cited by examiner

*Primary Examiner* — Edward Johnson

(74) *Attorney, Agent, or Firm* — Connolly Bove Lodge & Hutz LLP

(57) ABSTRACT

High energy reaction of halogen-containing carbon, boron, silicon and nitrogen compounds, with base component comprising at least one atom selected from Groups IA to VIA, transition metals, lanthanides and actinides of the Periodic Table of the Elements, excluding aluminum and aluminum oxide.

20 Claims, No Drawings

ENERGY GENERATION PROCESS

CROSS-REFERENCE TO RELATED APPLICATIONS

This application is a continuation application of U.S. patent application Ser. No. 11/212,184, filed Aug. 26, 2005, now U.S. Pat. No. 8,034,989.

BACKGROUND OF THE INVENTION

The development of explosives has been important in the history of civilization. The earliest explosives were deflagrating, beginning with black powder. Roger Bacon, in the thirteenth century, detailed the preparation of black powder. It was originally used in firearms, and not until the seventeenth century was it used in mines.

Detonating explosives were developed in the nineteenth century, based on the work of Alfred Nobel. Mr. Nobel succeeded in mixing nitroglycerin with an absorbent instead of a liquid which was difficult to handle and dangerous to transport. A solid substance, dynamite, was developed that was sensitive to the action of a blasting cap, but was relatively insensitive to ordinary shock.

Since the development of detonating explosives, continuing effort has been directed to maximize both the explosive force and the safety of explosive compositions and processes. Ammonium nitrate-fuel oil compositions have been effective explosives and safe to transport, but exhibited relatively modest detonating energy.

A wide variety of high energy reactions has been explored to discover means for generating a high heat of reaction and explosive energy. The known thermite reaction, in which iron oxide is reacted with aluminum to form iron and aluminum oxide, can generate a heat of reaction of about 0.94 kcal per gram and will reach a temperature of about 2200° C. In addition, it has been recognized that chemical compounds that are exposed to high temperatures will rapidly decompose. It has also been recognized that the reaction of polytetrafluoroethylene with aluminum under pressure generates about 3.16 kcal per gram.

Despite a wide variety of known high energy reactions, including those noted above, continued effort has been directed toward the development of explosive processes that will yield exceptional energy.

BRIEF SUMMARY OF THE INVENTION

The present invention is based on the discovery of a process that generates a heat of reaction that is many times greater than the explosive power of TNT (0.88 kcal/gram).

Specifically, the instant invention provides a process for generating energy by bringing together, with energy sufficient to break a halogen chemical bond, at least one halogen-containing component of the general formula $RX_{(n)}$, wherein R is a moiety containing at least one of carbon, boron, silicon and nitrogen; X is a halogen-containing moiety; and n is a positive integer, and at least one base component comprising at least one atom selected from Groups IA to VIA, transition metals, lanthanides and actinides of the Periodic Table of the Elements, excluding aluminum and aluminum oxide.

Various embodiments of the present invention are directed to processes comprising:

(a) providing a mixture comprising:

(i) a halogen-containing compound of the general formula $RX_{(n)}$ wherein R represents a moiety comprising at least one carbon atom, each X independently represents a halogen-containing moiety, and n is a positive integer, and wherein the halogen-containing compound has at least one carbon-halogen bond; and (ii) a base component comprising at least one atom selected from Groups IA to VIA, transition metals, lanthanides and actinides of the Periodic Table of the Elements, excluding aluminum and aluminum oxide; and (b) supplying energy to at least a portion of the mixture sufficient to break the at least one carbon-halogen bond to form a free halogen such that the free halogen reacts directly with the base component to form a metal halide from the halogen and base component.

DETAILED DESCRIPTION OF THE INVENTION

As used herein, the singular terms "a" and "the" are synonymous and used interchangeably with "one or more" and "at least one," unless the language and/or context clearly indicates otherwise. Accordingly, for example, reference to "a base component" herein or in the appended claims can refer to a single base component or more than one base component. Additionally, all numerical values, unless otherwise specifically noted, are understood to be modified by the word "about."

The instant invention is applicable to a wide variety of halogen-containing compounds of the general formula $RX_{(n)}$, wherein R is a moiety containing at least one of carbon, boron, silicon and nitrogen; each X is a halogen-containing moiety; and n is a positive integer. The size of this component can vary widely, from monomeric compounds to complex polymers having thousands of repeating units. The composition of this component can also vary widely. The compounds include, for example, fluorocarbons and chlorofluorocarbons such as those typically used for solvents and refrigerants, polychlorinated biphenyls, chlorinated dioxins, as well as normally solid halogenated materials such as polyvinylchloride (PVC), polytetrafluoroethylene (PTFE) and perfluoropolyether. In the above formula, the present invention has been found to be particularly thermodynamically efficient with fluorine and chlorine-containing compounds. It has also been found to be particularly efficient in compounds in which R is carbon or boron, and those compounds are accordingly preferred. Those halogen containing compounds in which R is carbon exhibit unusually high thermodynamic efficiency, and are accordingly especially preferred.

In accordance with the present invention, the halogen-containing compound is brought together (i.e., mixed and reacted) with at least one base component as defined above. Elemental materials can be used as well as compounds thereof with anions or cations, and alloys, functional groups, substituent groups, ligands, complexes, free radicals, and chelates of these elements, excluding aluminum metal and aluminum oxide. Typical of such compounds are oxides, hydrides, nitrates, borates, amides, amines, chlorates, hydroxides, azides, and phosphates of the metal component. Of these, oxides, hydrides and nitrates have been found to be particularly convenient and effective, and are accordingly preferred. The particular application of the process will determine which specific halogen-containing component and which base component are the most effective. The toxicity and reactivity of the materials and their respective reaction products should be considered in the material selection of these components. The full thermodynamic and physical effects should be calculated when determining the materials, amounts, and conditions to be used.

In accordance with the present invention, the two components are brought together (i.e., mixed and reacted) with energy sufficient to break the halogen bond or bonds in the halogen-containing compound. As will be evident to those skilled in the art, as with other chemical reactions, the amount of energy will vary with the specific compound selected, the temperature, amounts and purity of the components, the methods of preparation, the particle sizes and shapes, molecular weights, heat capacities, ambient conditions, and the method used to supply the energy. For example, sufficient energy can be easily provided by the thermite reaction instead of heating by conventional means. The energy can be supplied in any convenient form, including heat, electricity (including, for example, static electricity, alternating current and direct current), electromagnetic radiation (including, for example, lasers and microwave radiation), atomic radiation, pressure, or other chemical reactions such as conventional explosives, primers or detonators. To minimize the production of undesired byproducts, the energy should be provided substantially instantaneously. The classic thermite reaction can be used to initiate the process. The thermite reaction provides the substantially instantaneous transfer of energy sufficient to break the halogen bond(s) in a localized area and initiate the process. However, less vigorous techniques for supplying the energy can be used by consideration of the specific compounds used and the other factors noted above. As will be evident to one skilled in the art, if insufficient energy is provided, the energy is not provided in an expedient fashion, or if the components are present in substantially non-stoichiometric amounts, the desired conversions may not be completed, and toxic compounds, including ones that may be in violation of various international treaties, may be produced. It is important to note that special safety precautions including, but not limited to, bunkers to contain possible blast effects, high airflow hoods (greater than 400 CFM) to ensure removal of toxic substances, and eye protection to protect the eyes from bright light and fragments should be considered when practicing the present process.

The order in which the halogen-containing component and the base component are brought together is not critical. The process can be operated by premixing and then adding energy, adding energy first and then mixing, or mixing and adding energy simultaneously. Partial pre-energizing and pre-mixing can also be used.

In one preferred embodiment of the present invention, the halogen-containing compound and the base metal component are present in substantially stoichiometric amounts. However, in another preferred embodiment, the process can be operated with excess halogen-containing reactant or binder such as perfluorosulfonic acid resin which, upon reaching its activation temperature, will generate fluorine based free radicals which can then be used for other purposes.

The process can also be operated with excess base metal components, which will result in the conversion of substantially all of the halogen-containing compounds to their respective metal halides.

The process can be carried out in multiple stages. For example, if $C_4F_{10}$ and boron hydride ($B_{10}H_{14}$) are used as the reactants and the reactants are surrounded by lithium hydride. Energy is added to the admixture of $C_4F_{10}$ and boron hydride by initiating a thermite reaction in the proximity to the admixture by bringing into contact iron oxide and aluminum metal in the presence of an initiator. The admixture reacts exothermically, generating about 3.25 kcal/gram of reactant. The products for this reaction are $BF_3$, $CO_2$, and $H_2O$. The $BF_3$ will then react exothermically with the lithium hydride in a secondary reaction, generating about 21.64 kcal/gram of lithium hydride reacted. The products for this reaction are LiF, $B_2O_3$, and $H_2O$.

The process can be used on a nanoparticle scale as well as the conventional macro and micro scales. The components do not have to be pure. In fact, in one specific application of the present invention, halogen contaminants can be removed from landfills and other contaminated sites.

The energy generated in the process of the present invention can be discarded or used in a wide variety of applications, including high explosives, incendiaries, rocket fuels, replacements for cartridges and propellants, making steam, fuel additives, corrosion applications, chemical reaction precursors, chemical reaction initiation, chemical recovery and destruction of halogen-containing moieties, chemical lasers, heaters, waste materials disposal, and a variety of weapons.

The invention will now be described in further detail with reference to the following non-limiting examples.

EXAMPLES

Example 1

A reaction is carried out by admixing 74.2% perfluoroethane ($C_2F_6$) and 25.8% lithium hydride in air. Energy is added to the admixture by initiating a thermite reaction in the proximity to the admixture by bringing into contact iron oxide and aluminum metal in the presence of an initiator. The admixture reacts exothermically, generating about 6.5 kcal/gram of reactant. The products for this reaction are LiF, $CO_2$, and $H_2O$.

Example 2

The general procedure of Example 1 is repeated, except that perflouroethylene ($C_2F_4$) and magnesium oxide are used as the reactants. This reaction requires air. $C_2F_4$ is present in 56.3% of the mixture and magnesium oxide is present in 43.7% of the mixture. The admixture will react exothermically, generating about 1.48 kcal/gram of reactant. The products for this reaction are $MgF_2$ and $CO_2$.

Example 3

The general procedure of Example 1 is repeated, except that PTFE (polytetrafluoroethylene), calcium oxide, and calcium nitrate are used as the reactants. This reaction requires no air. The mixture is composed of 29.5% PTFE, 23.9% calcium oxide, and 46.6% calcium nitrate. The admixture will react exothermically, generating about 1.95 kcal/gram of reactant. The products for this reaction are $CaF_2$, CaO, $N_2$, $CO_2$, and $H_2O$.

Example 4

The general procedure of Example 1 is repeated, except that 1, 2, 4 trichlorobenzene ($C_6H_3Cl_3$) and calcium oxide are used as the reactants. This reaction requires air. The mixture is composed of 68.3% 1, 2, 4 trichlorobenzene and 31.7% calcium oxide. The admixture will react exothermically, generating about 2.68 kcal/gram of reactant. The products for this reaction are $CaCl_2$, $CO_2$, and $H_2O$.

Example 5

The general procedure of Example 1 is repeated, except that 2, 4, 6 tribromo-n-cresol ($C_7H_5Br_2O$) and calcium carbonate are used as the reactants. This reaction requires air. The mixture is composed of 69.7% 2, 4, 6 tribromo-n-cresol and 30.3% calcium carbonate. The admixture will react exothermically, generating about 1.86 kcal/gram of reactant. The products for this reaction are $CaBr_2$, $CO_2$, and $H_2O$.

Example 6

The general procedure of Example 1 is repeated, except that 2,3,5,6-tetrachlorobenzoquinone ($C_6Cl_4O_2$) and calcium carbonate are used as the reactants. This reaction requires air. The mixture is composed of 36% 2, 3, 5, 6 tetrachlorobenzoquinone and 64% calcium carbonate. The admixture will react exothermically, generating about 1.55 kcal/gram of reactant. The products for this reaction are $CaCl_2$, $CO_2$, and $H_2O$.

Example 7

The general procedure of Example 1 is repeated, except that 2,2 dichlorobiphenyl ($C_{12}H_8Cl_2$, PCB 4) and calcium oxide are used as the reactants. This reaction requires air. The mixture is composed of 79.9% 2,2 dichlorobiphenyl and 20.1% calcium oxide. The admixture will react exothermically, generating about 5.1 kcal/gram of reactant. The products for this reaction are $CaCl_2$, $CO_2$, and $H_2O$.

Example 8

The general procedure of Example 1 is repeated, except that N2F4 and boron nitride are used as the reactants. This reaction requires no air. The mixture is composed of 75.9% N2F4 and 24.1% boron nitride. The admixture will react exothermically, generating about 2.13 kcal/gram of reactant. The products for this reaction are $BF_3$ and $N_2$.

Example 9

The general procedure of Example 1 is repeated, except that $C_4F_{10}$ and boron hydride ($B_{10}H_{14}$) are used as the reactants and the reactants are surrounded by lithium hydride. This reaction requires air. The mixture is composed of 85.4% $C_4F_{10}$ and 14.6% boron hydride. The admixture of $C_4F_{10}$ and boron hydride will react exothermically, generating about 3.25 kcal/gram of reactant. The products for this reaction are $BF_3$, $CO_2$, and $H_2O$. If a ratio of 74.1% $BF_3$ and 25.9% lithium hydride is used, the $BF_3$ will then react exothermically with the lithium hydride in a secondary reaction, generating about 21.64 kcal/gram of lithium hydride reacted. The products for this reaction are LiF, $B_2O_3$, and $H_2O$.

Example 10

The general procedure of Example 1 is repeated, except that 2 chlorodibenzo-p-dioxin ($C_{12}H_7ClO_2$) and calcium oxide are used as the reactants. This reaction requires air. The mixture is composed of 88.6% 2-chlorodibenzo-p-dioxin and 11.4% calcium oxide. The admixture will react exothermically, generating about 5.46 kcal/gram of reactant. The products for this reaction are $CaCl_2$, $CO_2$, and $H_2O$.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A process comprising:

(a) providing a mixture comprising:

(i) a halogen-containing compound of the general formula $$RX_{(n)}$$

wherein R represents a moiety comprising at least one carbon atom, each X independently represents a halogen-containing moiety, and n is a positive integer, and wherein the halogen-containing compound has at least one carbon-halogen bond; and (ii) a base component comprising at least one atom selected from Groups IA to VIA, transition metals, lanthanides and actinides of the Periodic Table of the Elements, excluding aluminum and aluminum oxide; and (b) supplying energy to at least a portion of the mixture sufficient to break the at least one carbon-halogen bond to form a free halogen such that the free halogen reacts directly with the base component to form a metal halide from the halogen and base component.

2. The process according to claim 1, wherein energy is supplied to the portion of the mixture in an amount equal to or greater than about 0.94 kcal per gram of the portion of the mixture.

3. The process according to claim 1, wherein supplying energy to the portion of the mixture comprises heating the portion of the mixture.

4. The process according to claim 2, wherein supplying energy to the portion of the mixture comprises heating the portion of the mixture.

5. The process according to claim 1, wherein at least one X contains fluorine.

6. The process according to claim 1, wherein at least one X contains chlorine.

7. The process according to claim 1, wherein the halogen-containing compound comprises a chlorofluorocarbon.

8. The process according to claim 1, wherein the halogen-containing compound is present in the mixture in a stoichiometric excess.

9. The process according to claim 2, wherein the halogen-containing compound is present in the mixture in a stoichiometric excess.

10. The process according to claim 1, wherein the base component is present in the mixture in a stoichiometric excess and substantially all of the halogen atoms in the halogen-containing compound are converted to metal halide.

11. The process according to claim 2, wherein the base component is present in the mixture in a stoichiometric excess and substantially all of the fluorine atoms in the halogen-containing compound are converted to metal fluoride.

12. The process according to claim 4, wherein the base component is present in the mixture in a stoichiometric excess and substantially all of the chlorine atoms in the halogen-containing compound are converted to metal chloride.

13. The process according to claim 1, wherein the halogen-containing compound comprises perfluorooctanoic acid.

14. The process according to claim 1, wherein the halogen-containing compound comprises a polychlorinatedbiphenyl (PCB) compound.

15. The process according to claim 1, wherein the halogen-containing compound comprises a halogenated dioxin.

16. The process according to claim 1, wherein the halogen-containing compound comprises a polymeric compound.

17. The process according to claim 16, wherein the polymeric compound comprises one or more selected from the group consisting of polyvinyl chloride and polytetrafluoroethylene.

18. The process according to claim 1, wherein the halogen-containing compound comprises a chlorinated benzene compound.

19. The process according to claim 1, wherein the base component comprises at least one atom selected from the group consisting of calcium, magnesium and boron.

20. The process according to claim 2, wherein supplying heat to the mixture comprises providing heat from one or more selected from the group consisting of explosives, primers, detonators, electromagnetic radiation, atomic radiation, electricity, pressure and combinations thereof.

* * * * *